US005441363A

United States Patent [19]

Gray

[11] Patent Number: 5,441,363

[45] Date of Patent: Aug. 15, 1995

[54] LEACHING CHAMBER

[76] Inventor: Terrance H. Gray, 28 Webber Ave., Bath, Me. 04530

[21] Appl. No.: 236,499

[22] Filed: Apr. 29, 1994

[51] Int. Cl.[6] ..... E02B 11/00; E02B 13/00

[52] U.S. Cl. ..... 405/49; 405/43; 405/45; 138/173; 138/105

[58] Field of Search ..... 405/43, 45, 49; 138/121, 173, 105, 122; 52/125.2, 122.1

[56] References Cited

U.S. PATENT DOCUMENTS

| | | | |
|---|---|---|---|
| D. 207,293 | 3/1967 | Ferm | D91/1 |
| D. 329,684 | 9/1992 | Gray | D23/207 |
| 460,352 | 9/1891 | Reading . | |
| 680,548 | 8/1901 | Sikes . | |
| 980,442 | 1/1911 | Schafly . | |
| 1,541,918 | 6/1925 | Brennan . | |
| 2,153,789 | 4/1939 | Carswell et al. . | |
| 2,366,522 | 1/1945 | Gutman . | |
| 2,866,319 | 12/1958 | Nicholson . | |
| 3,333,422 | 8/1967 | Neyland . | |
| 3,339,366 | 9/1967 | Gogan et al. . | |
| 3,440,823 | 4/1969 | Olsen . | |
| 3,495,410 | 2/1970 | Bailey et al. . | |
| 3,570,251 | 3/1971 | Roberts . | |
| 3,579,995 | 5/1971 | Flynn | 61/13 |
| 3,645,100 | 2/1972 | La Monica | 61/13 |
| 3,820,341 | 6/1974 | Richard et al. | 61/13 |
| 3,898,162 | 8/1975 | Carlson et al. | 210/170 |
| 3,910,051 | 10/1975 | Komisarek | 61/11 |
| 3,962,088 | 6/1976 | Kuhlenschmidt et al. | 210/170 |
| 4,162,976 | 7/1979 | Monson | 210/170 |
| 4,166,720 | 9/1979 | Weber | 23/230 |
| 4,183,696 | 1/1980 | Auriemma | 405/43 |
| 4,192,628 | 3/1980 | Gorman | 405/45 |
| 4,239,416 | 12/1980 | Borca et al. | 405/53 |
| 4,245,924 | 1/1981 | Fouss et al. | 405/45 |
| 4,360,042 | 11/1982 | Fouss et al. | 138/119 |
| 4,363,563 | 12/1982 | Hallenius et al. | 405/55 |
| 4,379,654 | 4/1983 | Rovelli | 405/53 |
| 4,523,613 | 6/1985 | Fouss et al. | 138/121 |
| 4,588,325 | 5/1986 | Seefert | 405/46 |
| 4,598,277 | 7/1986 | Feldman | 340/604 |
| 4,624,603 | 11/1986 | Kanau | 405/49 |
| 4,759,661 | 7/1988 | Nichols | 405/48 |
| 4,790,567 | 12/1988 | Kawano | 285/24 |
| 4,797,030 | 1/1989 | Lockwood | 405/125 |
| 5,087,151 | 2/1992 | DiTullio | 405/43 |
| 5,110,459 | 5/1992 | Baxter | 210/143 |
| 5,156,488 | 10/1992 | Nichols | 405/48 |
| 5,234,286 | 8/1993 | Wagner | 405/53 |

OTHER PUBLICATIONS

May, "Technical Support Paper for *The Infiltrator* Leaching System" (Apr. 1987).

Infiltrator Systems, Inc., "The No Gravel Leaching Field System You can Haul In One Truck, *The Infiltrator*" (*Marketing Brochure*).

*Primary Examiner*—Randolph A. Reese

*Assistant Examiner*—Frederick L. Lagman

*Attorney, Agent, or Firm*—Hamilton, Brook, Smith & Reynolds

[57] ABSTRACT

A leaching chamber for burial in the ground includes non-symmetrical corrugations extending laterally across the leaching chamber. Each corrugation has a ridge and a shoulder with the ridge being higher than the shoulder and sloping down from the ridge to the shoulder. Additionally, the ridge of each corrugation is also wider than the shoulder. The corrugations are oriented relative to each other such that the ridge of each corrugation is adjacent to the shoulder of an adjoining corrugation.

32 Claims, 12 Drawing Sheets

LEACHING CHAMBER

BACKGROUND

Hollow plastic leaching chambers are commonly buried in the ground to form leaching fields for receiving and dispersing liquids such as sewage system effluent or storm water into the surrounding earth. Such leaching chambers have a central cavity for receiving liquids. An opening on the bottom and slots on the sides provide the means through which liquids are allowed to exit the central cavity and disperse into the surrounding earth. Typically, multiple leaching chambers are connected to each other in series to achieve a desired subterranean volume and dispersion area. Leaching chambers are usually arch-shaped and corrugated with symmetrical corrugations for strength. Additionally, leaching chambers usually come in standard sizes. The most common size for most leaching chambers is roughly six feet long, three feet wide and slightly over one foot high.

The amount of liquid that a given leaching chamber is capable of receiving and dispersing is dependent upon the internal volume of the leaching chamber and the dispersion area over which the leaching chamber can disperse the liquids. Since most plastic leaching chambers are arch-shaped for strength, the volume and dispersion area for any given leaching chamber having the same dimensions is roughly the same. Therefore, most present leaching chambers of the same size have roughly the same capacity.

The capacity of a leaching field depends upon the size and the number of leaching chambers employed. If the size or the number of the leaching chambers employed in a leaching field is increased, the volume and dispersion area is increased, thereby increasing capacity of the leaching field. However, increasing the size or the number of leaching chambers also increases the cost as well as the area of land required for burying the leaching chambers.

SUMMARY OF THE INVENTION

The present invention provides a standard sized leaching chamber which is capable of receiving and dispersing 10% more liquids than existing leaching chambers of the same size. Such a leaching chamber allows less leaching chambers to be employed for a given application and, therefore, reduces costs.

The present invention resides in a leaching chamber for burial in the ground including a hollow load bearing structure or conduit having a longitudinal axis. The conduit comprises a plurality of corrugations extending in directions transverse to the longitudinal axis. Each corrugation is non-symmetrical about the longitudinal axis.

In preferred embodiments, each corrugation has a ridge, a central sloping section and a shoulder. The ridge is higher than the shoulder and the central section slopes down from the ridge to the shoulder. On the ridge side of the central axis of the chamber, the central section is convex when viewed from above. On the shoulder side, the central section becomes concave when viewed from above. The cross-section of each corrugation in the direction transverse to the longitudinal axis is non-symmetrical. Each ridge is also wider than the shoulder in the longitudinal direction such that the corrugations are also non-symmetrical when viewed from above. The corrugations are oriented relative to each other such that the ridge of each corrugation is adjacent to the shoulder of an adjoining corrugation. The orientation of the corrugations provides the conduit with a roof having lateral edges in which portions of the edges of the roof are higher than central portions of the roof. Additionally, the adjoining corrugations are laterally offset from each other relative to the longitudinal axis. Passages within the conduit enable liquids to leach from the conduit and vents in the corrugations allow air to escape from the conduit.

The conduit includes a pipe access port. The pipe access port is configured such that a discharge pipe may be coupled to the access port either from a direction parallel to the longitudinal axis or a direction transverse to the longitudinal axis of the conduit.

The conduit also includes a locking flange at a longitudinal end of the conduit for locking the conduit to another conduit. The locking flange includes a series of flange members which are offset from each other.

Another aspect of the present invention resides in an end cap for enclosing the end of the conduit. The end cap has a locking flange which includes a series of flange members. The flange members are offset from each other and are capable of mating and locking with the flange members of the conduit.

The present invention leaching chamber is roughly the same size as current leaching chambers but has a 10% larger volume which allows the present invention to receive and disperse 10% more liquids than obtainable with existing leaching chambers.

The conduit is fabricated to facilitate nesting of conduits in a stack of conduits for ease of transport. A base flange extending from each conduit has slots formed therein for facilitating the lifting of the conduit with tools. More specifically, knotted ropes attached to a crane are inserted into the slots so that one or more conduits can be easily lifted from a stack of conduits.

BRIEF DESCRIPTION OF THE DRAWINGS

The foregoing and other objects, features and advantages of the invention, including various novel details of construction and construction of parts, will be apparent from the following more particular drawings and description of preferred embodiments of the leaching chamber in which like reference characters refer to the same parts throughout the different views. The drawings are not necessarily to scale, emphasis instead being placed upon illustrating the principles of the invention. It will be understood that the particular leaching chambers embodying the invention are shown by way of illustration only and not as a limitation of the invention. The principles and features of this invention may be employed and varied in numerous embodiments without departing from the scope of the invention.

DETAILED DESCRIPTION OF THE PREFERRED EMBODIMENTS

Figure 1:
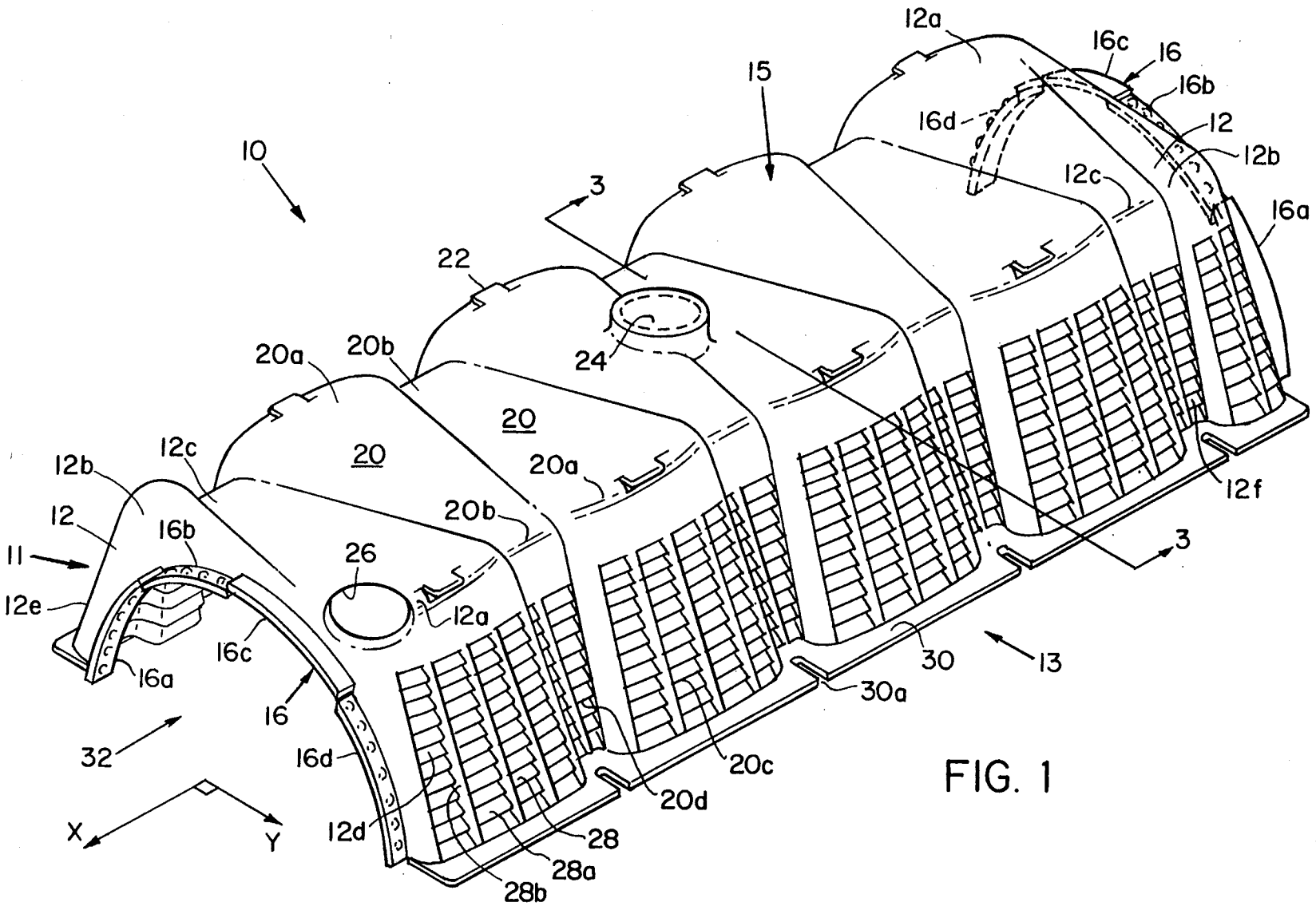
FIG. 1 is a perspective view of a preferred embodiment of a leaching chamber according to the invention.
Figure 2:
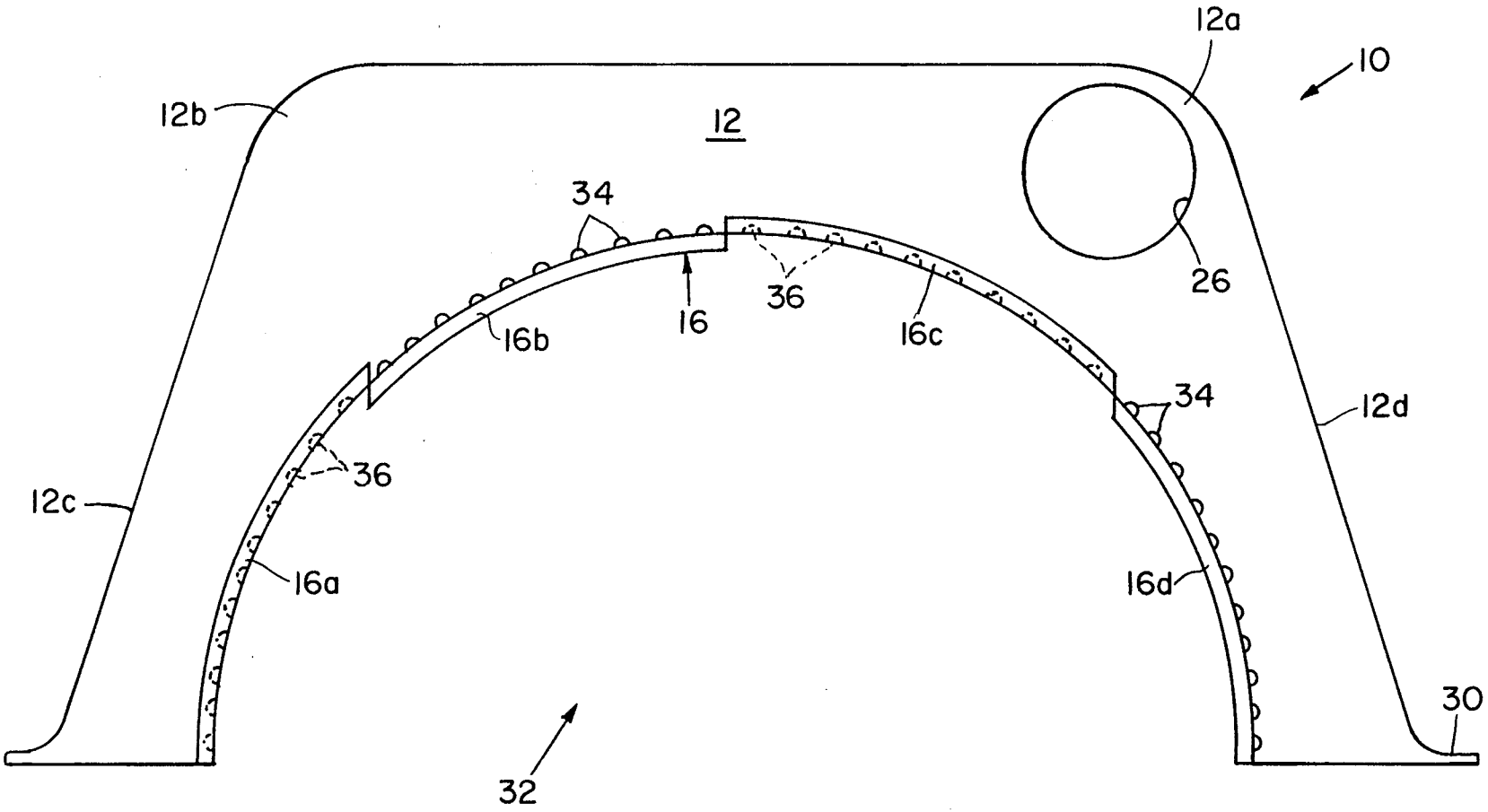
FIG. 2 is a front view of the leaching chamber of FIG. 1.
Figure 3:
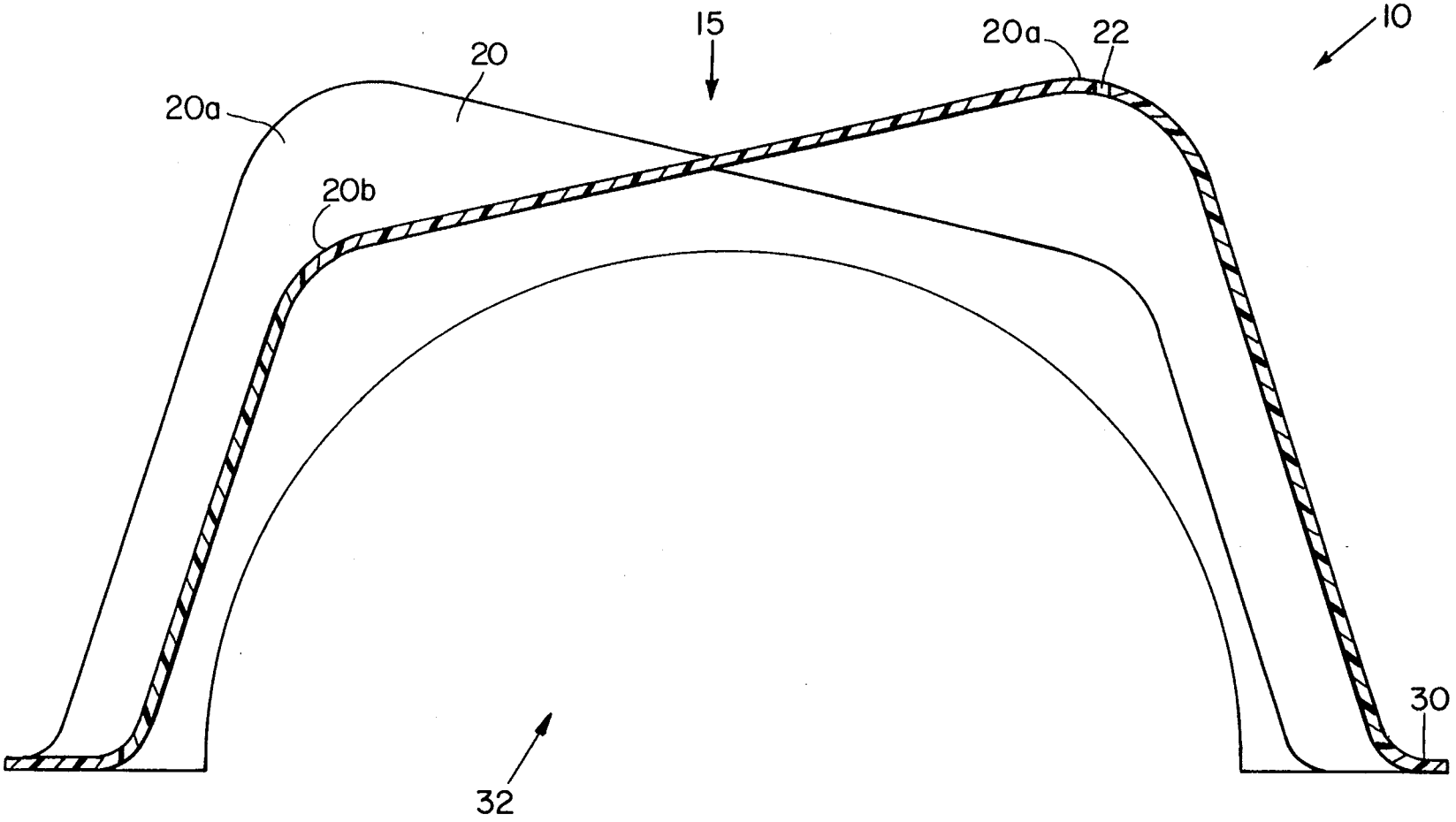
FIG. 3 is a cross-section of the leaching chamber taken along lines 3—3 of FIG. 1.
Figure 7:
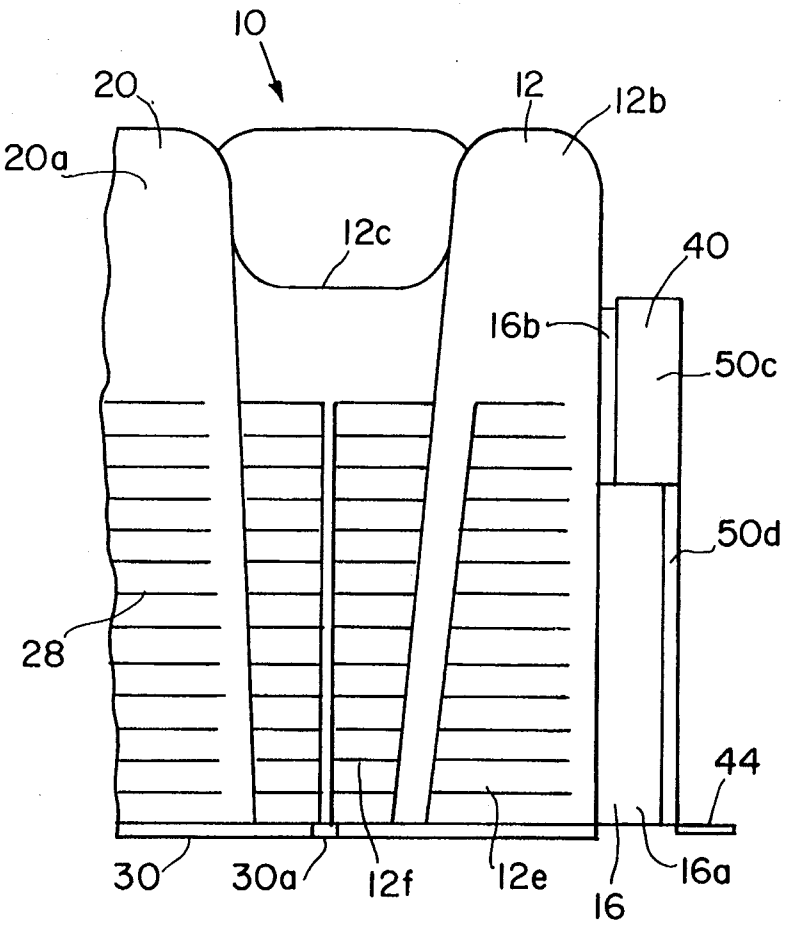
FIG. 7 is a side view of the end cap of FIG. 5 coupled to an end of the leaching chamber of FIG. 1.

Referring to FIGS. 1, 2 and 3, leaching chamber 10 is a corrugated plastic conduit for burial in the earth for receiving and dispersing liquids such as sewage system effluent or storm water. The liquids are discharged from a discharge pipe into central cavity 32 through pipe access port 26. Liquids which do not disperse into the earth through the open bottom of leaching chamber 10 are dispersed into the surrounding earth through slots 28*a* located on the sides 11 and 13 of the leaching chamber 10. Multiple leaching chambers 10 can be connected in series to each other by locking flanges 16 to form a continuous conduit. The open ends of the leaching chambers 10 located at the ends of the resultant conduit are closed by end caps 40 (FIG. 7).

Leaching chamber 10 includes a plurality of non-symmetrical lateral corrugations 20 which provide strength to the leaching chamber 10. The corrugations 20 cross leaching chamber 10 in directions transverse to the longitudinal axis X of leaching chamber 10. Each corrugation 20 has a ridge 20*a* and a shoulder 20*b* which are on opposite lateral edges of the leaching chamber 10. The ridge 20*a* of each corrugation 20 is higher than the shoulder 20*b* and slopes down from the ridge 20*a* to the shoulder 20*b*. As a result, the cross section of each corrugation 20 in the direction transverse to longitudinal axis X is non-symmetrical. Additionally, the ridge 20*a* is wider than the shoulder 20*b* in the longitudinal direction.

Each corrugation 20 is positioned adjacent to another corrugation 20 in a reversed orientation such that the ridge 20*a* of one corrugation 20 is adjacent to the shoulder 20*b* of the adjoining corrugation 20. The reversed orientation of adjacent corrugations 20 provides a roof 15 in which portions of the lateral edges of the roof are higher than a central section 15 of the roof as seen in FIG. 3. Additionally, each corrugation 20 is offset from the adjoining corrugation 20 such that the side 20*c* of ridge 20*a* of each corrugation 20 extends laterally beyond the side 20*d* of shoulder 20*b* of each adjoining corrugation 20. Offsetting the corrugations strengthens leaching chamber 10.

Figure 9:
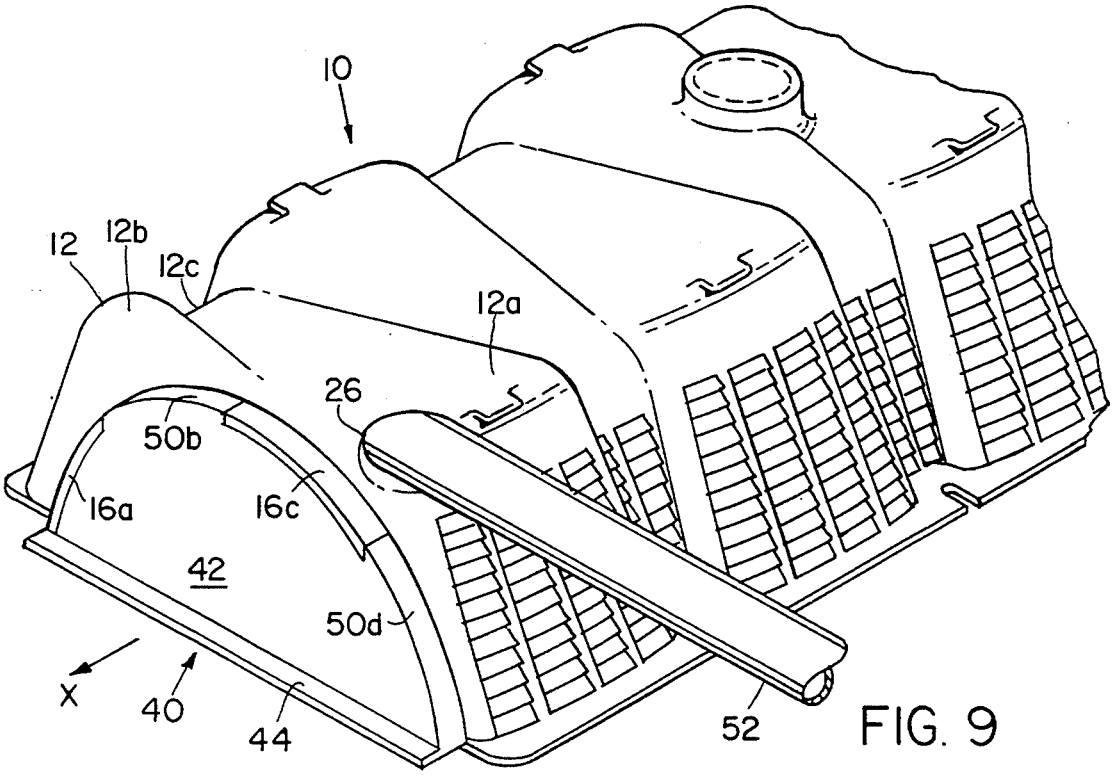
FIG. 9 is a perspective view of an end of the leaching chamber of FIG. 1 with a discharge pipe entering the access port in a direction perpendicular to the longitudinal axis of the leaching chamber.

Positioned at respective ends of leaching chamber 10 are end corrugations 12. Each end corrugation 12 includes a ridge 12*a*, an arm 12*b*, and a shoulder 12*c*. Each ridge 12*a* is higher than its respective shoulder 12*c* and slopes down from the ridge 12*a* to the shoulder 12*c*. However, the arm 12*b*, which is adjacent to shoulder 12*c*, is the same height as ridge 12*a*. This provides each end corrugation 12 with an end of uniform height and allows discharge pipe 52 to be coupled to pipe access port 26 in a direction perpendicular to the longitudinal axis X (FIG. 9). Additionally, arm 12*b* allows locking flange 16 to have a larger radius than if arm 12*b* was the same height as shoulder 12*c*. The side 12*e* of arm 12*b* extends laterally beyond the side 12*f* of shoulder 12*c* such that sides 12*e* and 12*f* are offset from each other in a manner similar to sides 20*c* and 20*d* of corrugations 20. The ridge 12*a* of each end corrugation 12 is positioned adjacent to a shoulder 20*b* of a corrugation 20.

The resulting structure of non-symmetrical corrugations 12 and 20 forms a leaching chamber 10 which has a non-symmetrical cross section for each cross section in the direction along the longitudinal axis X at least for each inner corrugation 20. In particular, each inner corrugation 20 has a central transverse axis Y which defines a non-symmetrical corrugation with reference to the longitudinal axis X. The ridges, shoulders and arms of corrugations 12 and 20 are curved to provide a smooth transition between each other resulting in a continuous series of smooth curves. The center of each ridge is higher than the edges. The non-symmetrical corrugations of leaching chamber 10 provides a structure with about a 10% greater internal volume than if the roof was arch-shaped. As a result, the amount of liquids that leaching chamber 10 can receive and disperse is about 10% greater than an arch-shaped leaching chamber having roughly the same base and height dimensions.

A locking flange 16 extends from each end corrugation 12 for locking leaching chamber 10 to another leaching chamber (FIG. 4) or for locking end caps 40 (FIG. 7) to the ends of the leaching chamber 10. Locking flanges 16 include curved flange members 16*a*, 16*b*, 16*c* and 16*d*. Flange members 16*a* and 16*c* are positioned on a larger radius than flange members 16*b* and 16*d* and are offset from them. Flange members 16*a* and 16*c* include indents 36 on their inner surfaces while flange members 16*b* and 16*d* include protrusions 34 on their exterior surfaces. The protrusions 34 and indents 36 on locking flange 16 mate with respective protrusions and indents of a locking flange on an end cap 40 or an adjoining leaching chamber to prevent movement in the axial direction. Although locking flange 16 is shown to have four flange members, alternatively, locking flange 16 can have more than four flange members or less than four flange members. In another preferred embodiment of the invention, the protrusions 34 and indents 36 are omitted from the flange members.

The sides 20*c* and 20*d* of corrugations 20 and sides 12*d*, 12*e* and 12*f* of end corrugations 12 are rounded and include slots 28*a* formed between louvers 28. A series of ribs 28*b* provide strength and separate rows of louvers 28 and slots 28*a* from each other. The slots 28*a* allow liquids to exit leaching chamber 10 and disperse into the surrounding earth. The louvers 28 are angled downward to prevent earth from entering leaching chamber 10 through slots 28*a*. Slots 28*a* and louvers 28 preferably wrap slightly around the curved corners of sides 20*c*, 20*d*, 12*d*, 12*e* and 12*f* for providing maximum liquid dispersion. Alternatively, slots 28*a* and louvers 28 can be made without curved portions (i.e. squared) for easier manufacturing.

The bottom of leaching chamber 10 includes base flanges 30. Slots 30*a* within base flange 30 allow a plurality of leaching chambers 10 to be lifted from a stack by inserting knotted ropes into slots 30*a* on a selected leaching chamber 10 anywhere on the stack and lifting the plurality of leaching chambers 10 from the stack with a crane.

The roof 15 of leaching chamber 10 includes a centrally located knockout 24 which can be removed to form an inspection port for inspecting the interior of leaching chamber 10. Additionally, another knockout forming a pipe access port 26 is located on the ridge 12*a* of each end corrugation 12 laterally offset from axis X and can be removed to provide access for a discharge pipe. The access port 26 is recessed into the corner of ridge 12*a* such that access port 26 appears to be circular when viewed along the longitudinal axis X as well as from transverse axis Y of leaching chamber 10. Access port 26 provides access for a discharge pipe to discharge effluent or storm water into leaching chamber 10 and allows the installation of discharge pipes after leaching chamber 10 has been moved into its proper position and connected to other leaching chambers.

A series of optional vents 22 can be located on ridges 12*a* and 20*a* to allow air to be vented from leaching chamber 10. This enables liquids to enter the leaching chamber 10 more rapidly. Usually, vents 22 are employed only for dispersing storm water. Vents 22 have a lip to prevent earth from entering the leaching chamber 10 from above the leaching chamber 10.

Figure 4:
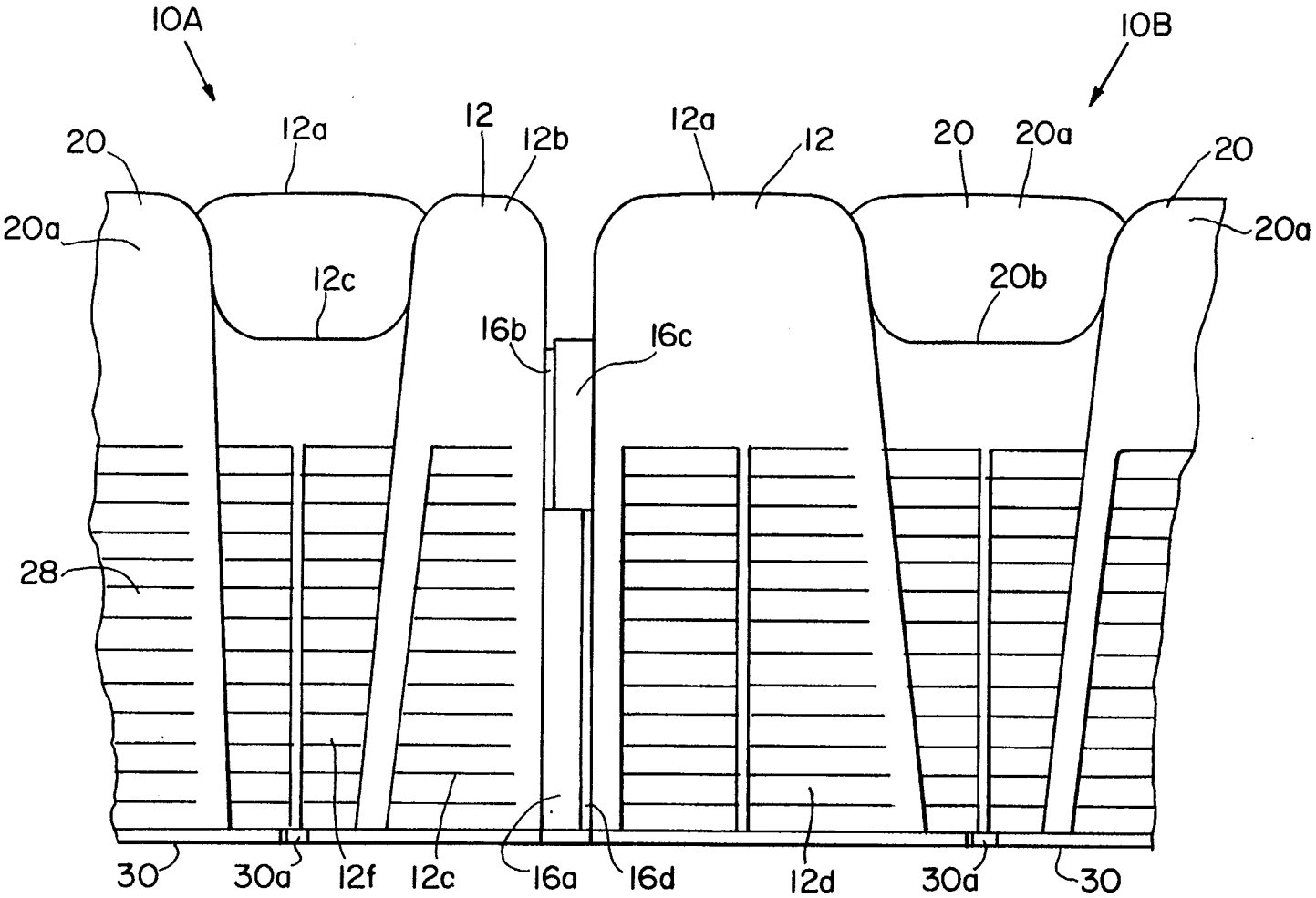
FIG. 4 is a side view of two leaching chambers coupled together.

Referring to FIG. 4, two leaching chambers 10A and 10B are coupled together by their respective locking flanges 16. Flange members 16*a* and 16*c* of leaching chamber 10A fit over respective flange members 16*d* and 16*b* of leaching chamber 10B. Additionally, flange members 16*b* and 16*d* of leaching chamber 10A fit under respective flange members 16C and 16*a* of leaching chamber 10A. The protrusions 34 on flange members 16*b* and 16*d* mate with indents 36 in flange members 16*a* and 16*c*. This prevents axial movement of leaching chambers 10A and 10B relative to each other.

Figure 5:
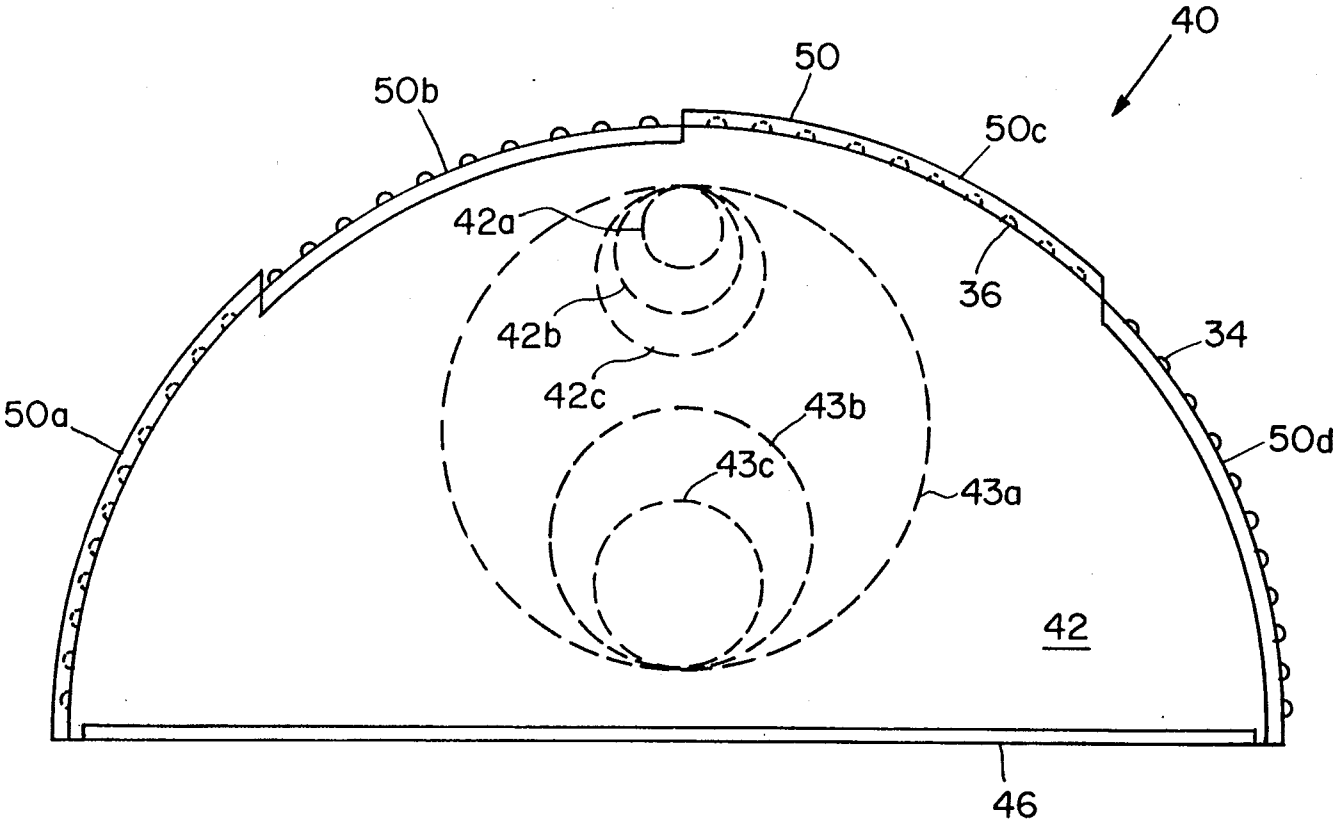
FIG. 5 is a rear view on the end cap.
Figure 6:
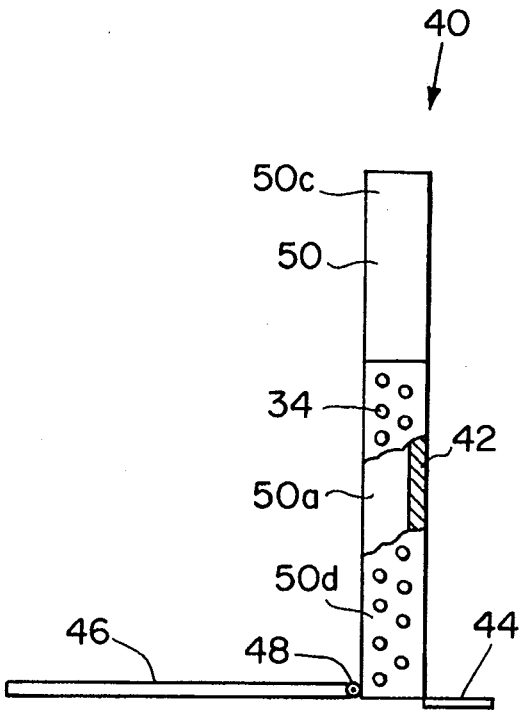
FIG. 6 is a side view of the end cap of FIG. 5 with a portion of a flange broken away.

FIGS. 5, 6 and 7 depict an end cap 40 for enclosing the ends of leaching chamber 10. End cap 40 includes a semi-circular end wall 42 having knockouts 42*a*, 42*b* and 42*c* which provide access for various standard sized discharge pipes when removed. End cap 40 also includes outlined targets 43*a*, 43*b* and 43*c* which can be sawed out and removed to provide access for standard sized discharge pipes. End cap 40 includes a lower flange 44 which provides strength and stiffness to end wall 42. A splash plate 46 extends from the bottom of end wall 42 and may include a hinge 48 so that splash plate 46 can pivot. Splash plate 46 protects the earth from being eroded under the leaching chamber 10 by liquids discharged into leaching chamber 10 through access hole 26. Although end wall 42 is depicted to be substantially solid, end wall 42 can include louvers and slots to permit liquids to exit leaching chamber 10 through end cap 40.

A curved locking flange 50 similar to locking flange 16 of leaching chamber 10 extends from end wall 42. Locking flange 50 includes flange members 50*a*, 50*b*, 50*c* and 50*d* which are offset from each other in order to mate and lock with locking flange 16. Flange members 50*a* and 50*c* of end cap 40 fit over respective flange members 16*d* and 16*b* of leaching chamber 10 while flange members 50*b* and 50*d* fit under respective flange members 16*c* and 16*a*.

Figure 8:
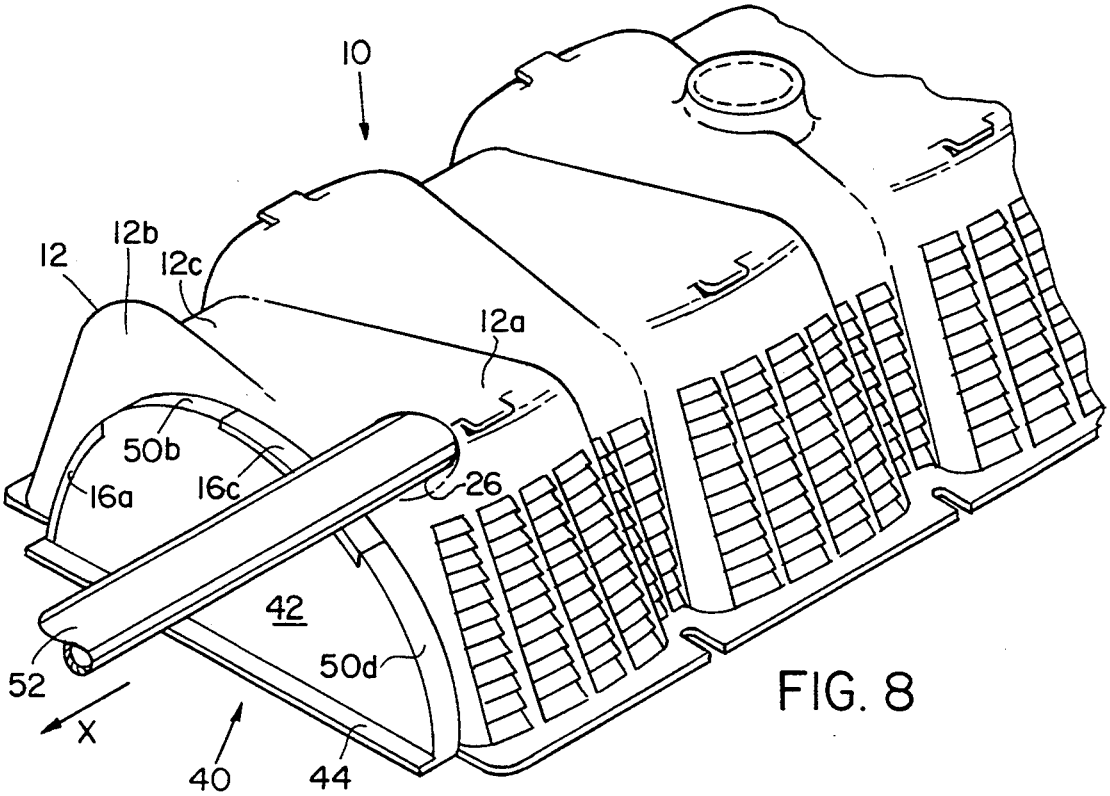
FIG. 8 is a perspective view of an end of the leaching chamber of FIG. 1 with a discharge pipe entering the access port in a direction parallel to the longitudinal axis of the leaching chamber.

FIGS. 8 and 9 depict the manner in which a discharge pipe 52 for discharging liquids into leaching chamber 10 can be coupled to access port 26. Access port 26 is located on the corner of ridge 12*a* of end corrugation 12 and is configured to allow a discharge pipe 52 to be coupled to leaching chamber 10 from at least two different directions. It is desirable for the discharge pipe 52 to be coupled to the highest point possible on leaching chamber 10. In prior art arch-shaped leaching chambers, this point is near the top of the arch along the center line of the leaching chamber. However, in the present invention leaching chamber 10, the highest and most suitable point is on ridge 12*a* which is offset from the longitudinal axis X. In FIG. 8, discharge pipe 52 is inserted into access port 26 from the direction parallel to the longitudinal axis X of leaching chamber 10. In FIG. 9, discharge pipe 52 is inserted into port 26 from the direction perpendicular to the longitudinal axis X of leaching chamber 10. The pipe could be inserted from any angle between the two positions illustrated if an adapter is used. By allowing discharge pipe 52 to be coupled to access port 26 from more than one direction, more flexibility is provided for coupling discharge pipe 52 to leaching chamber 10.

Figure 10:
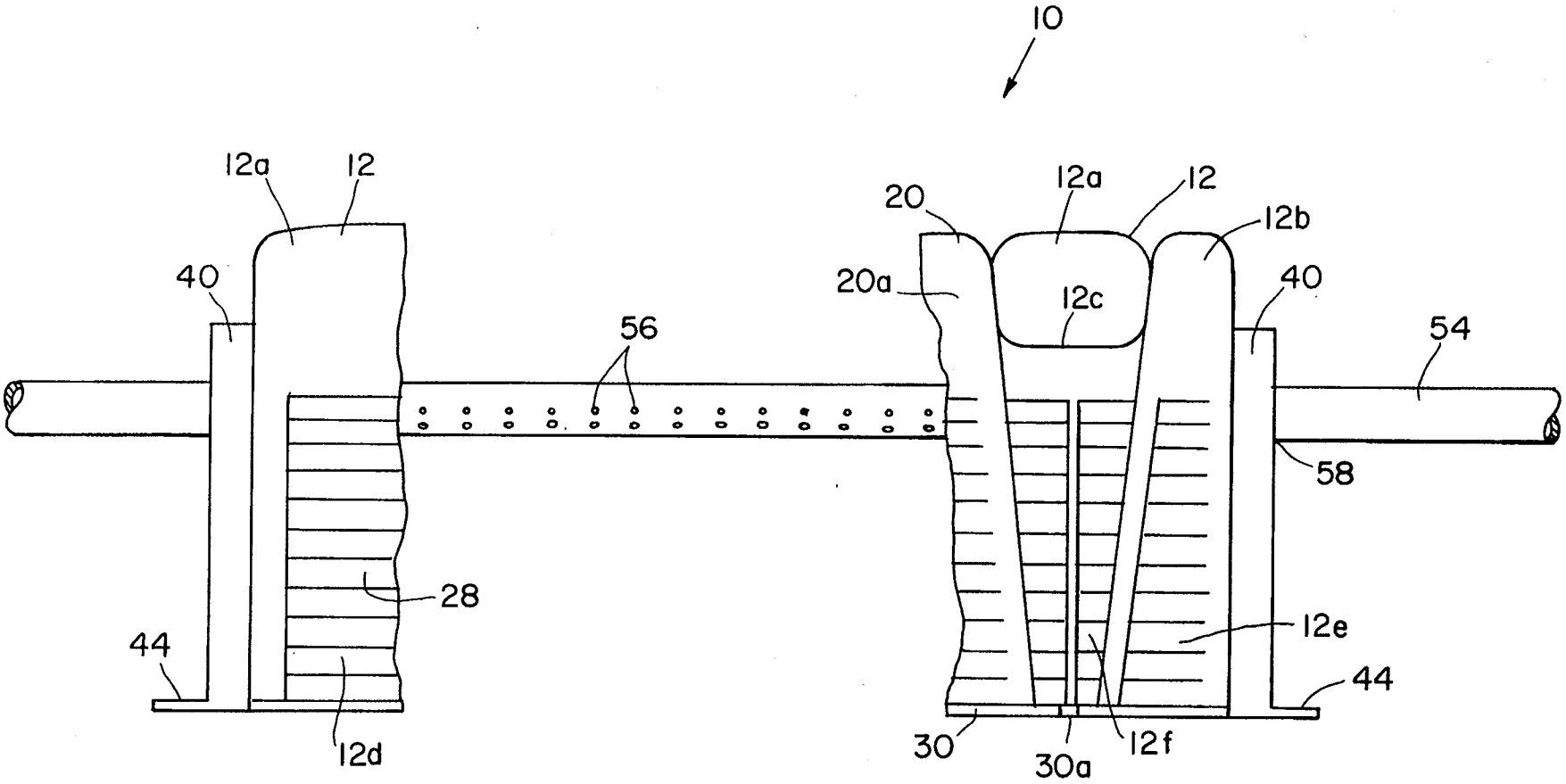
FIG. 10 is a side view of the leaching chamber of FIG. 1 with a portion broken away to show a discharge pipe extending through the leaching chamber.

FIG. 10 depicts another method of introducing liquids into leaching chamber 10. A pressurized discharge pipe 54 passes through leaching chamber 10 and through holes knocked or sawed out in the end caps 40. Discharge pipe 54 includes holes 56 which allow liquids within discharge pipe 54 to enter leaching chamber 10. The pressure of liquids within discharge pipe 54 allows liquids to be evenly distributed within leaching chamber 10. A pressurized pipe can also be connected to leaching chamber 10 through port 26.

Figure 11:
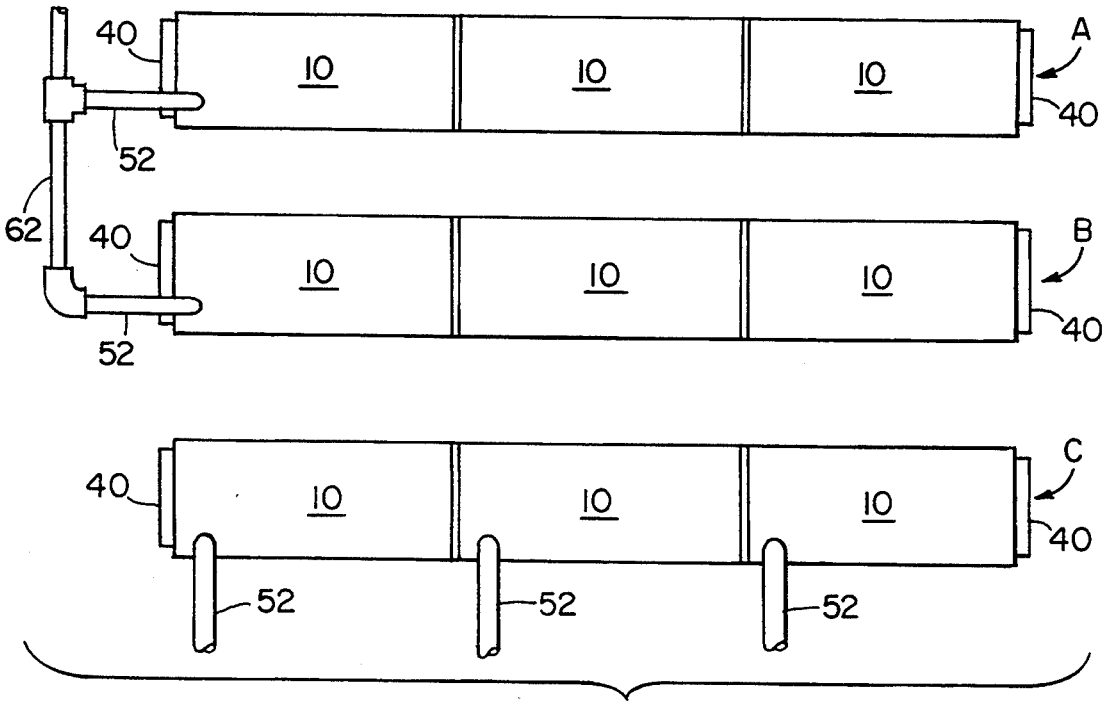
FIG. 11 is a top view of an array of leaching chambers coupled to a series of discharge pipes.

FIG. 11 depicts an array of leaching chambers 10 in which discharge pipes 52 are connected to the leaching chambers 10 in two different ways. Rows A and B are each supplied by a single discharge pipe 52 which in turn is supplied by a common pipe 62. Alternatively, in row C, every leaching chamber 10 is supplied by individual discharge pipes 52 which can be used to increase the flow of liquid into the leaching chambers 10.

Figure 12:
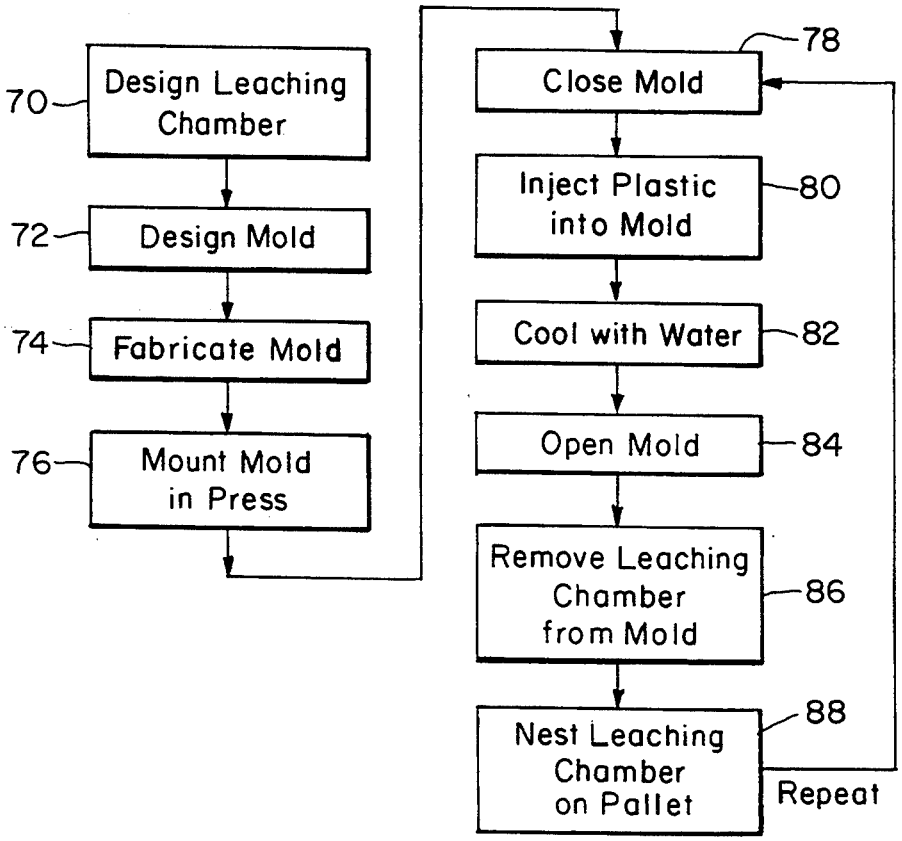
FIG. 12 is a flow chart of the manufacturing process of a preferred embodiment of a leaching chamber.

FIG. 12 depicts the manufacturing steps in which the present invention leaching chamber 10 is manufactured. In step 70, the leaching chamber is first designed, preferably by computer aided design (CAD) but, alternatively, can be manually drawn on paper. In step 72, a mold for molding the leaching chamber is designed. In step 74, the mold is fabricated, preferably in two or more parts or sections. In step 76, the mold is mounted in an injection molding press. In step 78, the mold is closed and plastic is injected into the mold in step 80. In step 82, the mold is cooled with water. In step 84, the mold is opened and the molded leaching chamber is removed in step 86. The leaching chamber is then nested on a pallet in step 88. If multiple leaching chambers are desired, steps 78 through 88 are then repeated. Although the present invention leaching chamber is preferably injection molded from plastic, alternatively, leaching chamber 10 can be made by other suitable methods such as by stamping or forging a sheet or blank of plastic.

Figure 13:
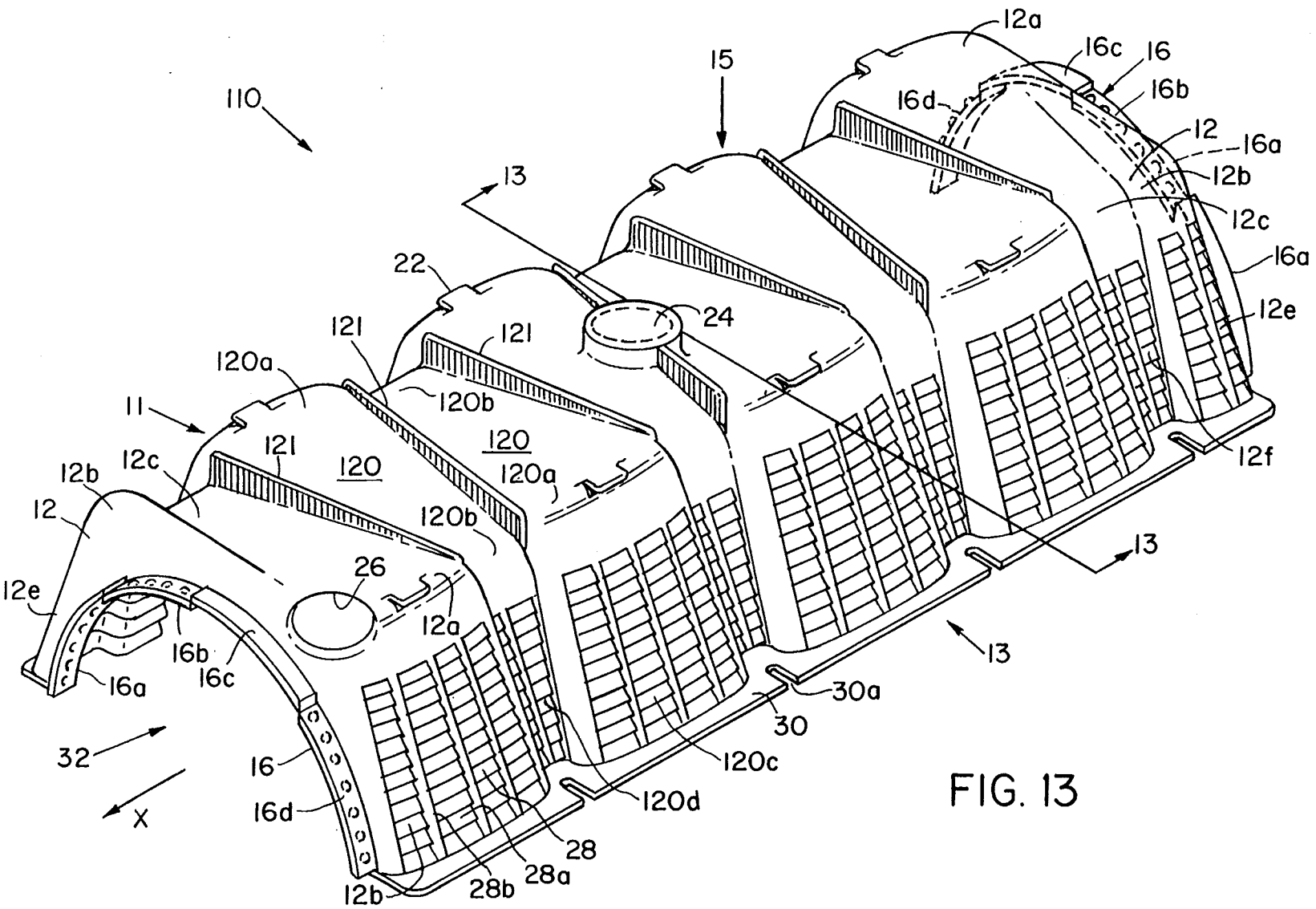
FIG. 13 is a perspective view of another preferred embodiment of the invention.
Figure 14:
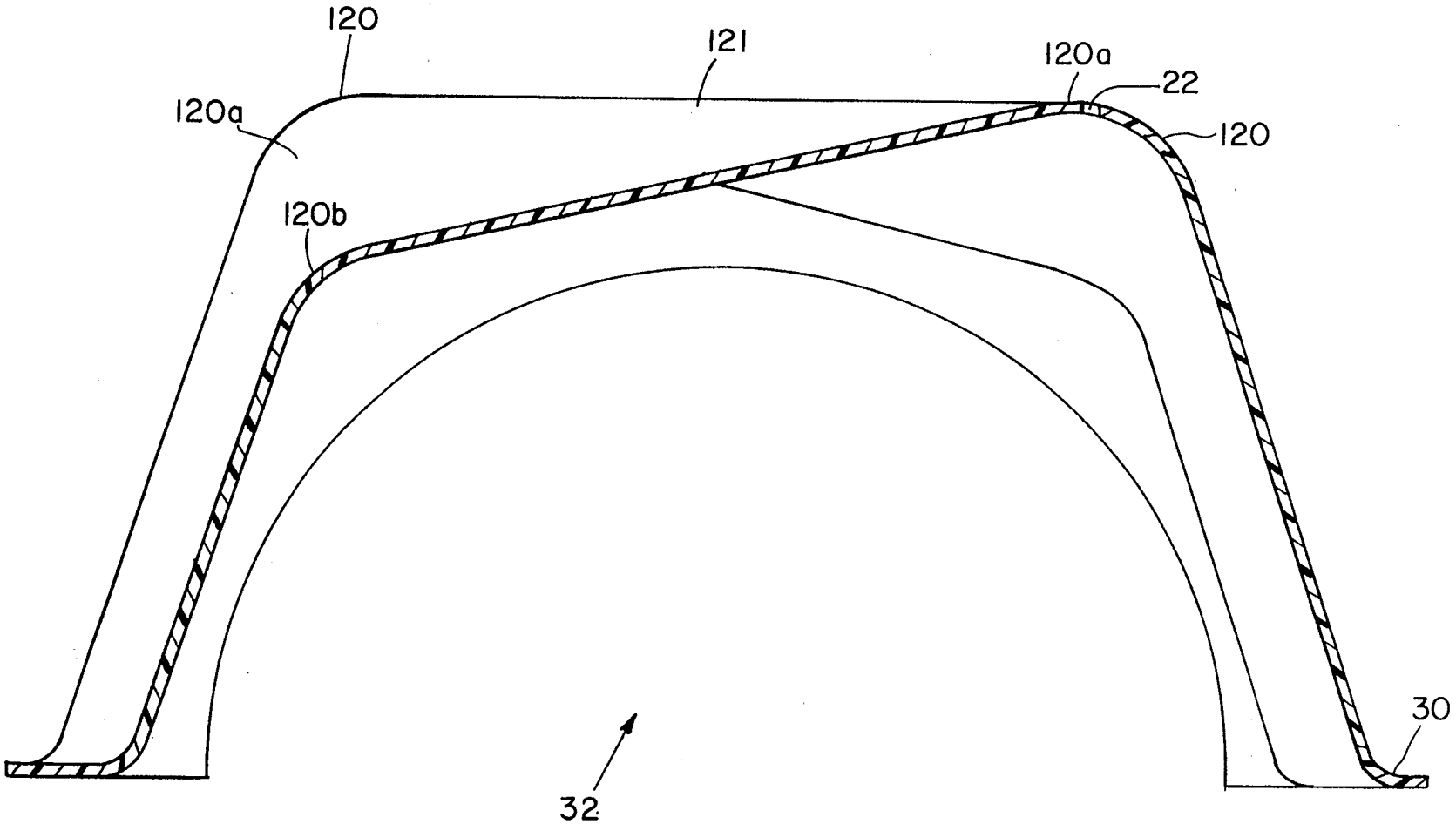
FIG. 14 is a cross-section of the leaching chamber of FIG. 13 taken along lines 13—13.

FIGS. 13 and 14 depict another preferred embodiment of the present invention. Leaching chamber 110 is similar to leaching chamber 10 but differs in that a series of external webs 121 extend across the roof 15 of leaching chamber 110 between sides 11 and 13 to provide strength. Webs 121 connect adjacent corrugations 120 to each other as well as connect end corrugations 12 to adjacent corrugations 120. Webs 21 extend from the top of a ridge 120*a* or 12*a* from one corrugation to the top of a ridge 120*a* of an adjacent corrugation 20. Each web 121 curves smoothly into the adjacent corrugation 12 or 20 to provide a smooth transition between the corrugations and the webs.

Leaching chambers 10 and 110 are preferably made from high density polyethylene. Alternatively, leaching chambers 10 and 110 can be made of other suitable plastics or from other materials such as concrete, ceramics or metals.

Figure 15:
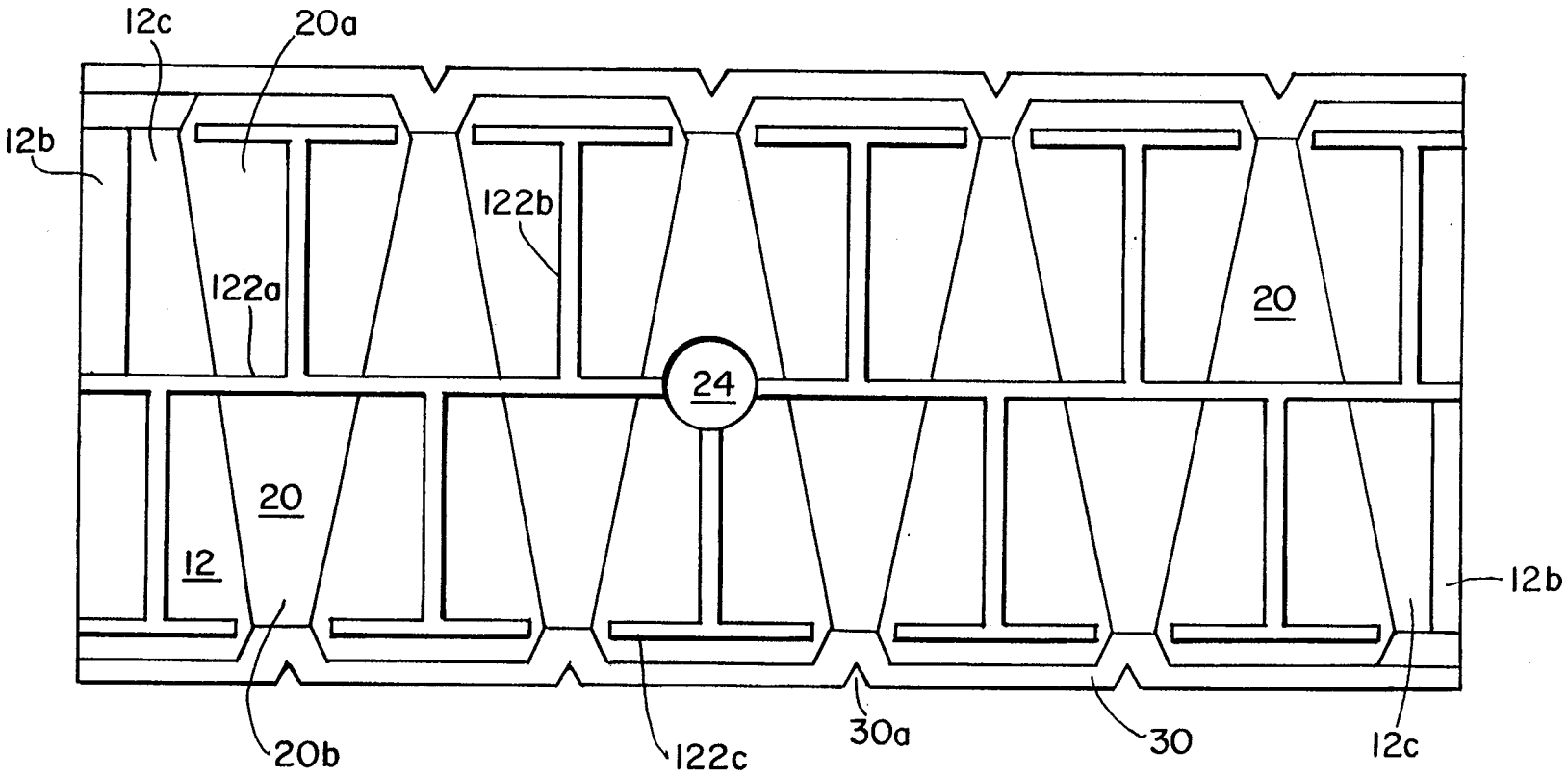
FIG. 15 is a bottom view of another preferred embodiment of the invention.

FIG. 15 is a bottom view of another preferred embodiment of the invention. The interior of corrugations 12 and 20 preferably have webs or structural ribs 122 to increase the strength of leaching chamber 10. However, because leaching chamber 10 must be stackable for transportation, the size of the internal structural ribs must be kept to a minimum. As a result, the majority of the structural strength of leaching chamber 10 is provided by the corrugations 12 and 20. Alternatively, corrugations 12 and 20 can be made without internal ribs or webbing.

As illustrated, there is a longitudinal web 122*a* running the length of the leaching chamber 10 along the longitudinal axis X. Each corrugation 20 also has a transverse rib 122*b* extending along the transverse axis Y from the longitudinal rib 122*a* to the respective ridge center 20*a* of that corrugation 20. The transverse ribs 122*b* is preferably curved to follow the contour of the slope of the corrugation 20. Each corrugation 20 can also have a longitudinal rib 122*c* at the respective ridge 20*a*, which also follows the contour of the ridge 20*a*. The need for internal stiffening depends in part on the material used for the leaching chamber 10 and the dimensions of the corrugations 20. In a preferred embodiment, a transverse rib is not used on the shoulder side of the longitudinal rib 122*a* because the shoulder side is narrower than the ridge side.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. For example, although the present invention leaching chamber has been shown to have an open bottom, the bottom may be closed. Additionally, the non-symmetrical corrugations in the present invention can be employed for other purposes such as for forming tunnels or free standing structures.

What is claimed is:

1. A conduit for burial in the ground, the conduit having a longitudinal axis with corrugations extending across the conduit in directions transverse to the longitudinal axis, each corrugation having a ridge and a shoulder, the ridge being higher than the shoulder such that a cross-section of a corrugation in a direction transverse to the longitudinal axis is non-symmetrical, the corrugations being orientated relative to each other such that the ridge of each corrugation is adjacent to the shoulder of an adjoining corrugation.

2. The conduit of claim 1 in which the ridge of each corrugation is wider than the shoulder in the longitudinal direction.

3. The conduit of claim 1 in which each corrugation slopes down from the ridge to the shoulder.

4. The conduit of claim 1 in which adjoining corrugations are laterally offset from each other relative to the longitudinal axis.

5. The conduit of claim 1 further comprising passages for enabling liquids to leach from the conduit.

6. The conduit of claim 1 further comprising vents in the corrugations for allowing air to escape from the conduit.

7. The conduit of claim 1 further comprising a locking flange at a longitudinal end of the conduit for locking the conduit to another conduit, the locking flange including a series of flange members which are offset from each other.

8. The conduit of claim 7 further comprising an end cap for enclosing the end of the conduit, the end cap comprising a locking flange, which includes a series of flange members which are offset from each other, the flange members of the end cap being capable of mating and locking with the flange members of the conduit.

9. The conduit of claim 1 further comprising a base flange extending from the conduit, the base flange having slots formed therein for facilitating the lifting of the conduit with tools.

10. The conduit of claim 1 further comprising a pipe access port offset from the longitudinal axis of the conduit.

11. The conduit of claim 1 further comprising a plurality of external webs disposed between the adjoining corrugations.

12. The conduit of claim 11 wherein the external webs intersect the longitudinal axis at acute angles.

13. The conduit of claim 1 wherein the corrugations include end corrugations, each end corrugation at a respective end of the conduit and having an arm extending from the ridge transverse to the longitudinal axis, the arm being of substantially the same height as the ridge.

14. A conduit for burial in the ground, the conduit having a longitudinal axis with corrugations extending across the conduit in directions transverse to the longitudinal axis, each corrugation having a ridge and a shoulder, the ridge being wider than the shoulder in the longitudinal direction, the corrugations being orientated relative to each other such that the ridge of each corrugation is adjacent to the shoulder of an adjoining corrugation.

15. The conduit of claim 14 in which adjoining corrugations are laterally offset from each other relative to the longitudinal axis.

16. The conduit of claim 14 further comprising passages for enabling liquids to leach from the conduit.

17. The conduit of claim 14 further comprising vents in the corrugations for allowing air to escape from the conduit.

18. The conduit of claim 14 further comprising a locking flange at a longitudinal end of the conduit for locking the conduit to another conduit, the locking flange including a series of flange members which are offset from each other.

19. The conduit of claim 14 further comprising an end cap for enclosing the end of the conduit, the end cap comprising a locking flange, which includes a series of flange members which are offset from each other, the flange members of the end cap being capable of mating and locking with the flange members of the conduit.

20. The conduit of claim 14 further comprising a base flange extending from the conduit, the base flange having slots formed therein for facilitating the lifting of the conduit with tools.

21. The conduit of claim 14 further comprising a pipe access port offset from the longitudinal axis of the conduit.

22. The conduit of claim 14 further comprising external webs disposed between the adjoining corrugations.

23. The conduit of claim 22 wherein the external webs intersect the longitudinal axis at acute angles.

24. The conduit of claim 14 wherein the corrugations include end corrugations disposed at each end of the conduit, each end corrugation having an arm extending from the ridge transverse to the longitudinal axis, the arm having substantially the same height as the ridge.

25. A conduit for burial in the ground, the conduit having a longitudinal axis with corrugations extending across the conduit in directions transverse to the longitudinal axis, the conduit including a base flange extending from the conduit, the base flange having slots formed therein for facilitating the lifting of the conduit with tools.

26. A method of installing a conduit for receiving and dispersing liquids comprising the steps of:

burying a conduit in the ground, the conduit having a longitudinal axis with corrugations extending across the conduit in directions transverse to the longitudinal axis, at least one corrugation having a ridge and a shoulder, the ridge being higher than the shoulder such that a cross-section of the corrugation in a direction transverse to the longitudinal axis is non-symmetrical, the corrugations being orientated relative to each other such that the ridge of each corrugation is adjacent to the shoulder of an adjoining corrugation; and coupling a discharge pipe to an access port at a location offset from the longitudinal axis of the conduit.

27. The method of claim 26 further comprising the step of coupling the conduit to a second conduit with mating locking flanges located on each conduit, each locking flange comprising a series of flange members which are offset from each other, the flange members of the conduits mating together and locking the conduits together.

28. A leaching conduit for burial in the ground and having a longitudinal axis, the conduit comprising:

a plurality of corrugations alternating along the longitudinal axis and extending across the conduit in directions transverse to the longitudinal axis, each corrugation having a ridge and a shoulder, the ridge being higher than the shoulder such that a cross-section of each corrugation in a direction transverse to the longitudinal axis is non-symmetrical, each corrugation being oriented relative to each other such that the ridge of each corrugation is adjacent to the shoulder of an adjoining corrugation;

a pipe access port formed in each of a pair of end corrugations and offset from the longitudinal axis of the conduit; and a locking flange at the longitudinal ends of the conduit for locking the conduit to another conduit, the locking flange including a series of flange members which are offset from each other, the locking flange at each end being identical.

29. The conduit of claim 28 wherein the end corrugations include an arm extending from the ridge transversely to the longitudinal axis, the arm having the same height as the ridge.

30. The conduit of claim 28 further comprising a plurality of external webs disposed between the corrugations.

31. The conduit of claim 30 wherein the external webs intersect the longitudinal axis at acute angles.

32. The conduit of claim 28 wherein the pipe access ports is formed to receive an inflow pipe oriented either parallel or transverse to the longitudinal axis.

* * * * *